US006833168B2

(12) United States Patent
Lucas et al.

(10) Patent No.: US 6,833,168 B2
(45) Date of Patent: Dec. 21, 2004

(54) ELECTROSTATOGRAPHIC RECORDING PAPER

(75) Inventors: Paul C. Lucas, Sherwood, OR (US); Beta Y. Ni, Sherwood, OR (US)

(73) Assignee: Xerox Corporation, Stamford, CT (US)

( * ) Notice: Subject to any disclaimer, the term of this patent is extended or adjusted under 35 U.S.C. 154(b) by 35 days.

(21) Appl. No.: 10/172,890

(22) Filed: Jun. 14, 2002

(65) Prior Publication Data

US 2003/0232178 A1 Dec. 18, 2003

(51) Int. Cl.[7] ..... B41M 5/40

(52) U.S. Cl. ..... 428/32.18; 428/32.22; 428/32.31; 428/32.33; 156/230

(58) Field of Search ..... 428/32.18, 32.22, 428/32.31, 32.33, 195, 212, 213, 220, 480; 156/230

(56) References Cited

U.S. PATENT DOCUMENTS 4,526,847 A * 7/1985 Walker et al. ..... 430/18
5,145,749 A * 9/1992 Matthew ..... 428/511
5,451,458 A * 9/1995 Malhotra ..... 428/412
5,663,029 A 9/1997 Malhotra ..... 430/126
5,663,030 A 9/1997 Malhotra ..... 430/126
6,139,948 A * 10/2000 Kobayashi et al. ..... 428/331
6,177,222 B1 1/2001 McAneney et al. ..... 430/124

* cited by examiner

*Primary Examiner*—B. Shewareged
(74) *Attorney, Agent, or Firm*—Judith L. Byorick

(57) ABSTRACT

Disclosed is a recording paper which comprises (a) a cellulosic base sheet having a first surface and a second surface opposite the first surface, said base sheet having a dielectric constant of at least about 1.5 under conditions of about 50 percent relative humidity and at about 23° C., said base sheet having a dielectric constant of no more than about 10 under conditions of about 50 percent relative humidity and at about 23° C., said base sheet having, under conditions of about 50 percent relative humidity and at about 23° C., a surface resistivity of at least about $1\times10^{7}$ ohms per square, said base sheet having, under conditions of about 50 percent relative humidity and at about 23° C., a surface resistivity of no more than about $1\times10^{13}$ ohms per square; (b) on the first surface of the base sheet an image receiving coating comprising a monomeric or polymeric material, said image receiving coating having a glass transition temperature of at least about 55° C., said image receiving coating having a surface resistivity that is within about 10 percent of the surface resistivity of the base sheet, said image receiving coating having a gloss value of at least about 50 GU; and (c) on the second surface of the base sheet a back coating comprising a monomeric or polymeric material, said back coating having a surface resistivity that is within about 10 percent of the surface resistivity of the base sheet.

32 Claims, No Drawings

ELECTROSTATOGRAPHIC RECORDING PAPER

BACKGROUND OF THE INVENTION

The present invention is directed to recording papers suitable for use in electrostatographic printing processes. More specifically, the present invention is directed to coated papers that, when used in electrostatographic recording processes, including electrography, electrophotography, xerography, ionography, and the like, enable generation of glossy prints that simulate those obtained with silver halide technology. One embodiment of the present invention is directed to a recording paper which comprises (a) a cellulosic base sheet having a first surface and a second surface opposite the first surface, said base sheet having a dielectric constant of at least about 1.5 under conditions of about 50 percent relative humidity and at about 23° C., said base sheet having a dielectric constant of no more than about 10 under conditions of about 50 percent relative humidity and at about 23° C., said base sheet having, under conditions of about 50 percent relative humidity and at about 23° C., a surface resistivity of at least about $1\times10^{7}$ ohms per square, said base sheet having, under conditions of about 50 percent relative humidity and at about 23° C., a surface resistivity of no more than about $1\times10^{13}$ ohms per square; (b) on the first surface of the base sheet an image receiving coating comprising a monomeric or polymeric material, said image receiving coating having a glass transition temperature of at least about 55° C., said image receiving coating having a surface resistivity that is within about 10 percent of the surface resistivity of the base sheet, said image receiving coating having a gloss value of at least about 50 GU; and (c) on the second surface of the base sheet a back coating comprising a monomeric or polymeric material, said back coating having a surface resistivity that is within about 10 percent of the surface resistivity of the base sheet.

Recording substrates for electrostatic printing processes are known. For example, U.S. Pat. No. 5,663,029 (Malhotra), the disclosure of which is totally incorporated herein by reference, discloses a process for generating images which comprises (1) generating an electrostatic latent image on an imaging member in an imaging apparatus; (2) developing the latent image; and (3) transferring the developed image to a recording sheet which comprises (a) a substrate; (b) a coating on the substrate which comprises (1) a binder selected from the group consisting of (A) polyesters; (B) polyvinyl acetals; (C) vinyl alcohol-vinyl acetal copolymers; (D) polycarbonates; and (E) mixtures thereof; and (2) an additive having a melting point of more than about 65° C. and a boiling point of more than about 150° C. and selected from the group consisting of (A) furan compounds; (B) pyrone and pyran compounds; (C) dioxane compounds; (D) aromatic anhydrides; (E) aromatic esters; (F) alkoxy compounds; (G) methylene dioxy compounds; (H) quinone compounds; and (I) mixtures thereof; (c) an optional filler; (d) an optional antistatic agent; and (e) an optional biocide.

U.S. Pat. No. 5,663,030 (Malhotra), the disclosure of which is totally incorporated herein by reference, discloses a process for generating images which comprises (1) generating an electrostatic latent image on an imaging member in an imaging apparatus; (2) developing the latent image; and (3) transferring the developed image to a recording sheet which comprises (a) a substrate; (b) a coating on the substrate which comprises (i) a polymeric binder selected from the group consisting of (A) copolymers of styrene and at least one other monomer; (B) copolymers of acrylic monomers and at least one other monomer; and (C) mixtures thereof; and (ii) an additive having a melting point of more than about 65° C. and a boiling point of more than about 150° C. and selected from the group consisting of (A) norbornane compounds; (B) phenyl compounds; and (C) mixtures thereof; (c) an optional filler; (d) an optional antistatic agent; and (e) an optional biocide. In a preferred embodiment, the latent image is developed with a liquid developer.

U.S. Pat. No. 6,177,222 (McAneney et al.), the disclosure of which is totally incorporated herein by reference, discloses a process which comprises forming an image on a substrate, and developing the image with toner, and wherein the substrate contains a coating of a polyester and there is enabled images of high uniform gloss.

While known compositions and processes are suitable for their intended purposes, a need remains for improved papers for use with electrostatic imaging processes. In addition, a need remains for papers that, when used in electrostatic imaging processes, generate images with uniform high gloss. Further, a need remains for papers that, when used in electrostatic imaging processes, generate images that approximate the look and feel of images printed on conventional high gloss silver halide photographic paper. Additionally, a need remains for papers that, when used in electrostatic imaging processes, enable high toner transfer efficiency in various different transfer systems, such as constant current roller systems, constant voltage roller systems, corona systems, and the like. There is also a need for coated high gloss papers that, when used in electrostatic imaging processes, enable high density toner transfer. In addition, there is a need for coated high gloss papers that, when used in electrostatic imaging processes, exhibit reduced or no dielectric breakdown in low toner density areas. Further, there is a need for coated high gloss papers that, when used in electrostatic imaging processes, enable generation of images wherein the gloss of the imaged areas approximately matches the gloss of unimaged areas. Additionally, there is a need for coated high gloss papers that, when used in electrostatic imaging processes, are compatible with a number of different fusing systems, including both those employing fuser oils and those employing no fuser oils. A need also remains for coated high gloss papers that can be used in electrostatic imaging processes to generate images with electrostatic dry toners. In addition, a need remains for coated high gloss papers that can be used in electrostatic imaging processes to generate images with electrostatic liquid developers. Further, a need remains for coated high gloss papers that, when used in electrostatic imaging processes, exhibit desirably low paper curl. Additionally, a need remains for coated high gloss papers that, when used in electrostatic imaging processes, exhibit good dimensional stability. There is also a need for coated high gloss papers that have relatively constant dielectric properties with respect to humidity to enable wide toner/paper transfer latitude across various environments. In addition, there is a need for coated high gloss papers wherein the coatings enable the paper thus coated to maintain relatively stable moisture content values across a wide range of relative humidity conditions. Further, there is a need for coated high gloss papers wherein the coatings enable the paper thus coated to maintain relatively heat capacity values across a wide range of relative humidity conditions. Additionally, there is a need for coated high gloss papers that have predictable fusing characteristics across a wide range of relative humidity conditions. A need also remains for coated high gloss papers that have predictable gloss characteristics across a wide range of relative humidity conditions. In addition, a need remains for coated high gloss papers that exhibit reduced curling when used in imaging processes. Further, a need remains for coated high gloss papers that enable toner transfer via control of the electrical properties of the paper. Additionally, a need remains for coated high gloss papers that exhibit desirable degrees of stiffness.

SUMMARY OF THE INVENTION

The present invention is directed to a recording paper which comprises (a) a cellulosic base sheet having a first surface and a second surface opposite the first surface, said base sheet having a dielectric constant of at least about 1.5 under conditions of about 50 percent relative humidity and at about 23° C., said base sheet having a dielectric constant of no more than about 10 under conditions of about 50 percent relative humidity and at about 23° C., said base sheet having, under conditions of about 50 percent relative humidity and at about 23° C., a surface resistivity of at least about $1\times10^{7}$ ohms per square, said base sheet having, under conditions of about 50 percent relative humidity and at about 23° C., a surface resistivity of no more than about $1\times10^{13}$ ohms per square; (b) on the first surface of the base sheet an image receiving coating comprising a monomeric or polymeric material, said image receiving coating having a glass transition temperature of at least about 55° C., said image receiving coating having a surface resistivity that is within about 10 percent of the surface resistivity of the base sheet, said image receiving coating having a gloss value of at least about 50 GU; and (c) on the second surface of the base sheet a back coating comprising a monomeric or polymeric material, said back coating having a surface resistivity that is within about 10 percent of the surface resistivity of the base sheet.

DETAILED DESCRIPTION OF THE INVENTION

The recording substrates of the present invention comprise a cellulosic substrate or base sheet having coatings on both lateral surfaces thereof. Any suitable substrate can be employed, such as sized blends of hardwood kraft and softwood kraft fibers, which blends typically contain from about 10 percent to 90 percent by weight of softwood and from about 90 to about 10 percent by weight of hardwood. Examples of hardwood include Seagull W dry bleached hardwood kraft, preferably present, for example, in one embodiment in an amount of about 70 percent by weight. Examples of softwood include La Tuque dry bleached softwood kraft present, for example, in one embodiment in an amount of about 30 percent by weight. These sized substrates can also contain pigments in typical amounts of from about 1 to about 60 percent by weight, such as clay (available from Georgia Kaolin Company, Astro-fil 90 clay, Engelhard Ansilex clay), titanium dioxide (available from Tioxide Company as Anatase grade AHR), calcium silicate CH-427-97-8, XP-974 (J. M. Huber Corporation), and the like. The sized substrates can also contain various effective amounts of sizing chemicals (for example from about 0.25 percent to about 25 percent by weight of pulp), such as Mon size (available from Monsanto Company), Hercon-76 (available from Hercules Company), Alum (available from Allied Chemicals as Iron free alum), and retention aid (available from Allied Colloids as Percol 292). The sizing values of the base papers expressed in Hercules Size Test values typically are at least about 0.4 second, and typically are no more than about 4,685 seconds; papers with sizing values of at least about 50 seconds and with sizing values of no more than about 300 seconds are preferred, primarily to decrease costs. The porosity values of the substrates, as measured with a Gurley Densometer, typically are at least about 15 seconds per 100 cubic centimeters of air, and typically are no more than about 60 seconds per 100 cubic centimeters of air, although the porosity value can be outside of these ranges. The cellulosic substrate typically has a thickness of at least about 50 microns, preferably at least about 90 microns, and more preferably at least about 100 microns, and typically has a thickness of no more than about 250 microns, preferably no more than about 200 microns, more preferably no more than about 175 microns, and even more preferably no more than about 125 microns, although the thickness can be outside of these ranges.

Illustrative examples of commercially available internally and externally (surface) sized cellulosic substrates suitable for the present invention include diazo papers, offset papers such as Great Lakes offset, recycled papers such as Conservatree, office papers such as Automimeo, Eddy liquid toner paper and copy papers from companies such as Nekoosa, Champion, Wiggins Teape, Kymmene, Modo, Domtar, Veitsiluoto and Sanyo, and Xerox® 4024 papers and sized calcium silicate-clay filled papers, with the Xerox® 4024 papers being particularly preferred in view of their availability and low print through. Also suitable are photographic paper base stocks, such as those available from Schoeller as SN2360 and SN2363 and those available from Consolidated as Centura and Reflexion Gloss 2 (supplied by Rollotek).

The cellulosic substrate or base sheet typically has a dielectric constant, measured in a direct current (DC) field at 50 percent relative humidity and at about 23° C., of at least about 1.5, and preferably at least about 2, and typically has a dielectric constant of no more than about 10, preferably no more than about 9, and more preferably no more than about 8, although the dielectric constant can be outside of these ranges. The cellulosic substrate or base sheet typically has a dielectric constant, measured in a direct current (DC) field at 10 percent relative humidity, of at least about 2, and typically has a dielectric constant of no more than about 9, although the dielectric constant can be outside of these ranges. The cellulosic substrate or base sheet typically has a dielectric constant, measured in a direct current (DC) field at 80 percent relative humidity, of at least about 10, and typically has a dielectric constant of no more than about 28, although the dielectric constant can be outside of these ranges.

In a specific embodiment, the cellulosic substrate or base sheet under conditions of about 50 percent relative humidity and at about 23° C. typically has a bulk resistivity typically of at least about $1\times10^{7}$ ohm-cm, preferably at least about $1\times10^{8}$ ohm-cm, and more preferably at least about $1\times10^{9}$ ohm-cm, and typically has a bulk resistivity of no more than about $1\times10^{13}$ ohm-cm, and preferably no more than about $1\times10^{10}$ ohm-cm, although the bulk resistivity can be outside of these ranges.

The cellulosic substrate or base sheet under conditions of about 50 percent relative humidity and at about 23° C. has a surface resistivity typically of at least about $1\times10^{7}$ ohms per square, preferably at least about $1\times10^{8}$ ohms per square, and more preferably at least about $1\times10^{10}$ ohms per square, and typically has a surface resistivity of no more than about $1\times10^{13}$ ohms per square, preferably no more than about $1\times10^{12}$ ohms per square, and more-preferably no more than about $1\times10^{11}$ ohms per square, although the surface resistivity can be outside of these ranges.

The cellulosic substrate or base sheet typically has a stiffness in machine direction of at least about 250 Gurley units, preferably at least about 300 Gurley units, and more preferably at least about 600 Gurley units, and typically has a stiffness of no more than about 2,500 Gurley units, and preferably no more than about 1,200 Gurley units, although the stiffness can be outside of these ranges. Stiffness in terms of Gurley units is measured according to TAPPI standard T543 om-00. By "in machine direction" is meant that as the paper is made, the fibers orient along the direction in which the paper machine moves; bending stiffness is measured in this direction as opposed to in the cross-direction.

The cellulosic substrate or base sheet typically has a weight of at least about 50 grams per square meter, preferably at least about 90 grams per square meter, and more preferably at least about 140 grams per square meter, and typically has a weight of no more than about 300 grams per square meter, preferably no more than about 250 grams per square meter, and more preferably no more than about 230 grams per square meter, although the weight can be outside of these ranges.

Situated on the first surface of the base sheet is an image receiving coating. The image receiving coating can be coated directly onto the first surface of the base sheet; alternatively, one or more intermediate coatings or layers, such as antistatic layers, anticurl layers, or the like, can be coated onto the first surface of the base sheet, followed by coating the image receiving coating onto these intermediate coatings or layers. Typical image receiving coatings are of polymeric materials with relatively low moisture permeability. Examples of suitable coating materials include polyesters, polyvinyl acetals, polyvinyl acetates, vinyl alcohol-vinyl acetal copolymers, polycarbonates, copolymers of styrene and at least one other monomer, copolymers containing acrylic monomers and at least one other monomer, and the like, as well as mixtures thereof. Specific examples of suitable coating materials include polyesters, such as polyester latexes, including AQ-29D, available from Eastman Chemicals, poly(4,4-dipropoxy-2,2-diphenyl propane fumarate) #324, available from Scientific Polymer Products, poly(ethylene terephthalate) #138 and #418, available from Scientific Polymer Products, poly(ethylene succinate) #150, available from Scientific Polymer Products, poly(1,4-cyclohexane dimethylene succinate) #148, available from Scientific Polymer Products, or the like; polyvinyl acetal and polyvinyl acetate polymers, such as #346, #347, and #024, available from Scientific Polymer Products, or the like; vinylalcohol-vinyl acetate copolymers, such as #379, available from Scientific Polymer Products, or the like; polycarbonates, such as #035, available from Scientific Polymer products, or the like; styrene-butadiene copolymers, such as those containing about 85 percent by weight styrene monomers and prepared as disclosed in U.S. Pat. No. 4,558,108, the disclosure of which is totally incorporated herein by reference, styrene-butadiene copolymers containing from about 5 to about 50 percent by weight styrene monomers and available as #199, #200, #201, #451, and #057 from Scientific Polymer Products, and the like; styrene-ethylene-butylene copolymers containing from about 5 to about 50 percent by weight styrene monomers and available as #453 from Scientific Polymer Products, and the like; styrene-isoprene copolymers, such as those with a styrene content of 50 percent by weight or more and prepared via living anionic polymerization techniques as disclosed by S. Malhotra et al. in *J. Macromol. Science-Chem.* A(20)7, page 733, the disclosure of which is totally incorporated herein by reference, and the like; styrene-alkyl acrylate copolymers, wherein alkyl is methyl, ethyl, propyl, butyl, pentyl, hexyl, or the like, styrene-aryl acrylate copolymers, wherein aryl is phenyl, benzyl, or the like, styrene-alkyl methacrylate copolymers, wherein alkyl is methyl, ethyl, isopropyl, butyl, hexyl, isodecyl, dodecyl, hexadecyl, octadecyl, or the like, such as those prepared via ultrasonic polymerization as described by S. Malhotra et al. in *J. Macromol. Science-Chem.* A18(5), page 783, the disclosure of which is totally incorporated herein by reference, or the like; styrene-aryl methacrylate copolymers, wherein aryl is phenyl, benzyl, or the like, such as those prepared via ultrasonic polymerization as described by S. Malhotra et al. in *J. Macromol. Science-Chem.* A18(5), page 783, or the like; styrene-butylmethacrylate copolymers, such as #595, available from Scientific Polymer Products, #18797, available from Polysciences Inc., or the like; styrene-allyl alcohol copolymers, such as #393 and #394, available from Scientific Polymer Products, or the like; styrene-maleic anhydride copolymers, such as those containing from about 50 to about 75 percent by weight styrene monomers, including #456, #049, #457, and #458, available from Scientific Polymer Products, or the like; and the like, as well as mixtures thereof. Monomers, or mixtures of monomers and polymers, can also be employed. Examples of suitable monomers include vinyl chloride, acrylonitrile, acrylic acid, acrylamide, and the like, as well as mixtures thereof.

The polymer in the image receiving coating typically has a weight average molecular weight of at least about 40,000, and typically has a molecular weight of no more than about 80,000, although the molecular weight can be outside of these ranges.

Optionally, the image receiving coating can also contain one or more fuser releasing agents, such as wax components to be used in an oilless fuser. Multiple release agents can be incorporated into the coating. Examples of suitable fuser releasing agents include carnauba wax, polyproprene, polyethylene, ester wax (behenic acid ester or aliphatic ester), and the like, as well as mixtures thereof. The melting point of these release agents typically is at least about 60° C., and preferably at least about 70° C., and typically is no more than about 110° C., and preferably no more than about 90° C., although the melting point can be outside of these ranges. When present, the optional fuser release agent is present in the coating typically in an amount of at least about 1 percent by weight of the coating, and typically in an amount of no more than about 12 percent by weight of the coating, although the relative amount can be outside of these ranges.

Optionally, the image receiving coating can also contain one or more antistatic agents. Any desired antistatic agent can be employed. Examples of suitable antistatic agents include metal oxides, such as tin oxide, indium tin oxide, silicon dioxide-tin oxide, antimony tin oxide, titanium tin oxide, and the like, all of which are particularly suitable for maintaining the desirable characteristics of the recording papers of the present invention, monoester sulfosuccinates, diester sulfosuccinates, sulfosuccinamates, diamino alkanes, anionic polymers, such as polystyrene sulfonates, phosphonium sulfonates, as disclosed in U.S. Pat. No. 4,943,380, the disclosure of which is totally incorporated herein by reference, sodium polyvinyl sulfuric acid, and the like, quaternary amines, including monomeric, oligomeric, and polymeric quaternary amines, such as. Cordex AT-172 and other materials available from Finetex Corp., quaternary acrylic copolymer latexes, such as polymethyl acrylate trimethyl ammonium chloride latex, such as HX42-1, available from Interpolymer Corp., quaternary choline halides, antistatic agents disclosed in, for example, U.S. Pat. No. 5,314,747, U.S. Pat. No. 5,320,902, U.S. Pat. No. 5,457,486, U.S. Pat. No. 5,441,795, U.S. Pat. No. 5,760,809, U.S. Pat. No. 5,663,030, and U.S. Pat. No. 5,663,029, the disclosures of each of which are totally incorporated herein by reference, and the like, as well as mixtures thereof.

Optional antistatic agents, when present, can be present in any desired or effective amount, typically at least about 0.1 percent by weight of the image receiving coating, and preferably at least about 0.5 percent by weight of the image receiving coating, and typically no more than about 10 percent by weight of the image receiving coating, and preferably no more than about 5 percent by weight of the image receiving coating, although the amount can be outside of these ranges.

Optionally, the image receiving coating can also contain filler components. Examples of filler components include colloidal silicas, such as Syloid 74, available from Grace Company, titanium dioxide (available as Rutile or Anatase from NL Chem Canada, Inc.), hydrated alumina (Hydrad TMC-HBF, Hydrad TM-HBC, available from J. M. Huber Corporation), barium sulfate (K. C. Blanc Fix HD80, available from Kali Chemie Corporation), calcium carbonate (Microwhite Sylacauga Calcium Products), high brightness clays (such as Engelhard Paper Clays), calcium silicate (available from J. M. Huber Corporation), cellulosic materials insoluble in water or any organic solvents (such as those available from Scientific Polymer Products), blends of calcium fluoride and silica, such as Opalex-C available from Kemira. O. Y, zinc oxide, such as Zoco Fax 183, available from Zo Chem, blends of zinc sulfide with barium sulfate, such as Lithopane, available from Schteben Company, and the like, as well as mixtures thereof.

Optional fillers, when present, can be present in any desired or effective amount, typically at least about 0.1 percent by weight of the image receiving coating, preferably at least about 0.3 percent by weight of the image receiving coating, and more preferably at least about 0.5 percent by weight of the image receiving coating, and typically no more than about 7 percent by weight of the image receiving coating, preferably no more than about 3 percent by weight of the image receiving coating, and more preferably no more than about 1 percent by weight of the image receiving coating, although the amount can be outside of these ranges.

Optionally, the image receiving coating can also contain beads to improve separation of the paper sheets during the paper handling process in the printer. Examples of suitable beads include hollow and solid microspheres, typically with an average particle diameter of at least about 0.1 micron, and preferably at least about 1 micron, and typically no more than about 50 microns, and preferably no more than about 10 microns, although the particle size can be outside of these ranges. Examples of hollow microspheres include ECCOSPHERES MC-37 (sodium borosilicate glass), ECCOSPHERES FTD 202 (high silica glass, 95 percent $SiO_2$), and ECCOSPHERES Si (high silica glass, 98 percent $SiO_2$), all available from Emerson and Cuming Inc.; FILLITE 200/7 (alumino-silicate ceramic, available from Fillite U.S.A.); Q-CEL 300 (sodium borosilicate, available from Philadelphia Quartz); B23/500 (soda lime glass, available from 3M Company); UCAR BJ0-0930 (phenolic polymers, available from Union Carbide); MIRALITE 177 (vinylidene chloride-acrylonitrile, available from Pierce & Steven, Chemical Corp.); and the like. Examples of solid microspheres include SPHERIGLASS E250P2 and 10002A (soda-lime glass A-glass, E-glass), available from Potters Industries; MICRO-P (soda-lime glass), available from D. J. Enterprises; ceramic microspheres (available from Fillite U.S.A. and Zeelan Industries); glass beads 3 to 10 microns (#07666, available from Polymer Sciences Inc); solid plastic microspheres, available from Rohm & Haas, Dow Chemicals, Diamond Shamrock, and E. I. DuPont de Nemours & Co.; hollow composite microspheres of polyvinylidene chloride/acrylonitrile copolymer shell, 15 percent by weight, and calcium carbonate, 85 percent by weight, available as DUALITE M 6001 AE, and DUALITE M 6017 AE from Pierce & Stevens Corporation, solid polymethyl methacrylate (PMMA) beads, such as those commercially available as MR-10G from Soken Chemical & Eng. Co.; and the like, as well as mixtures thereof. Mixtures of two or more types of microspheres can also be employed. Further information regarding microspheres is disclosed in, for example, *Encyclopedia of Polymer Science and Engineering*, Vol. 9, p. 788 et seq., John Wiley and Sons (New York 1987), the disclosure of which is totally incorporated herein by reference.

Optional beads, when present, can be present in any desired or effective amount, typically at least about 0.1 percent by weight of the image receiving coating, preferably at least about 0.3 percent by weight of the image receiving coating, and more preferably at least about 0.5 percent by weight of the image receiving coating, and typically no more than about 7 percent by weight of the image receiving coating, preferably no more than about 3 percent by weight of the image receiving coating, and more preferably no more than about 1 percent by weight of the image receiving coating, although the amount can be outside of these ranges.

The glass transition temperature of the image receiving coating typically is at least about 55° C., and preferably at least about 60° C., and typically is no more than about 200° C., more preferably no more than about 130° C., and even more preferably no more than about 85° C., although the glass transition temperature can be outside of these ranges.

The image receiving coating has a surface resistivity at 50 percent relative humidity and at about 23° C. typically of at least about $1\times10^7$ ohms per square, preferably at least about $1\times10^8$ ohms per square, and more preferably at least about $1\times10^9$ ohms per square, and typically of no more than about $1\times10^{13}$ ohms per square, preferably no more than about $1\times10^{12}$ ohms per square, and more preferably no more than about $10\times10^{11}$ ohms per square, although the surface resistivity of the image receiving coating can be outside of these ranges. The surface resistivity at 50 percent relative humidity and at about 23° C. of the image receiving coating typically is within about 10 percent of the surface resistivity at 50 percent relative humidity and at about 23° C. of the base sheet when expressed on a logarithmic scale, i.e., if the surface resistivity of the base sheet is about $5\times10^{10}$ ohms per square, the surface resistivity of the image receiving coating typically is from about $5\times10^9$ ohms per square to about $5\times10^{11}$ ohms per square. It should be noted that the surface resistivity of the image receiving coating is affected by the presence of intermediate coatings, pigment coatings placed on commercially obtained base sheets, or any other coating situated between the base sheet and the image receiving coating. The values stated herein for the surface resistivity of the image receiving coating refer to those values measured on the image receiving coating after it has been coated onto any intermediate layers present on the base sheet.

The surface finish of the image receiving coating typically has a surface roughness value (arithmetic average) of no more than about 1.4 microns, preferably no more than about 1.1 microns, more preferably no more than about 0.7 microns, and even more preferably no more than about 0.5 microns, and typically has a surface roughness value of at least about 0.3 microns, although the surface roughness value can be outside of these ranges.

The image receiving coating is present on the first surface of the base sheet in any desired or effective thickness, typically at least about 0.5 micron, preferably at least about 1 micron, and more preferably at least about 3 microns, and typically no more than about 6 microns, preferably no more than about 5 microns, although the thickness can be outside of these ranges.

The image receiving coating typically has a gloss value of at least about 50 GU (as measured with a 75° glossmeter (GLOSSGARD, available from Pacific Scientific) after the image receiving coating has been passed through an electrostatic imaging fuser and measured in non-image areas, i.e., areas where no toner is present), preferably at least about 70 GU, and more preferably at least about 80 GU, and typically has a gloss value of no more than about 110 GU, preferably no more than about 100 GU, and more preferably no more than about 90 GU, although the gloss value can be outside of these ranges.

When the recording paper of the present invention has been imaged by an electrostatic imaging process, the image receiving coating bearing the developed image exhibits relatively uniform gloss. Typically, the gloss value of the image receiving coating subsequent to imaging has a variance of no more than about 25 GU (as measured with a 75° glossmeter (GLOSSGARD, available from Pacific Scientific)), preferably no more than about 25 GU, more preferably no more than about 15 GU, and even more preferably no more than about 6 GU, although the gloss value can be outside of these ranges. By "variance" is meant that the difference between the highest gloss value measured on the imaged image receiving coating and the lowest gloss value measured on the imaged image receiving coating is within the values stated. This range, accordingly, can be used to make comparisons between any two areas of the imaged recording sheet, regardless of whether one or both areas are image areas (i.e., having toner thereon) or non-image areas (i.e., having no toner thereon).

The color of the recording paper of the present invention can be characterized using the CIE L*a*b color space method. These values can be measured by, for example, a dedicated spectrophotometer such as a GRETAG SPM50. In one specific embodiment, papers according to the present invention exhibit a value of L of at least about 93 (using a D65 illuminant), although the value of L can be outside of these ranges. In one specific embodiment, papers according to the present invention with a "cool white" color exhibit a value of a* of from about +0.5 to about −1 and a value of b* of from about −0.5 to about −10, although the values of a* and b* can be outside of these ranges. In another specific embodiment, papers according to the present invention with a "warm white" color exhibit a value of a* of from about −0.5 to about +2 and a value of b* of from about −0.5 to about +7, although the values of a* and b* can be outside of these ranges.

Situated on the second surface of the base sheet is a back coating. The base sheet is thus sandwiched between the back coating and the image receiving coating. The back coating can be coated directly onto the second surface of the base sheet; alternatively, one or more intermediate coatings or layers, such as antistatic layers, anticurl layers, or the like, can be coated onto the second surface of the base sheet, followed by coating the back coating onto these intermediate coatings or layers. Typical back coatings are nonhydrophilic materials, such as polyesters, including polyethylene terephthalate, polyethylene, polypropylene, nylon 6, nylon 6,6, other extrusion polymers, and the like, as well as mixtures thereof. Further, emulsion coatings can also be formulated to give adequate moisture barrier properties, including those based on acrylic polymers and styrene-acrylic copolymers, which may contain suitable crosslinkers for carboxy-terminated emulsion polymers, such as ammonium zirconium carbonate, to provide additional resistance to sticking to a hot fuser. Additionally, radiation-curable coatings can also be used to provide adequate moisture resistance, including UV and e-beam cured acrylate polymers and UV cationically-cured epoxy polymers. Other coating technologies can yield similar results, including aqueous solutions, solvent-based coatings, powder coatings, or those carried out in non-traditional solvents such as supercritical carbon dioxide.

Optionally, if desired, the back coating can also contain one or more antistatic agents. Any desired antistatic agent can be employed. Examples of suitable antistatic agents include those listed hereinabove as being suitable for use in the image receiving coating, and in the amounts indicated as being suitable for the image receiving coating. In addition, when radiation curable back coatings are employed, antistatic agents can be added in a form that can preclude aging problems, such as blooming; for example, the addition to the coating material of from about 0.1 to about 10 percent by weight of the coating of (2-(acryloyloxy)-ethyl)-trimethyl ammonium methyl sulfate or (2-(methacryloyloxy)-ethyl)-trimethyl ammonium chloride can provide covalently bound antistatic agents in an acrylate polymer coating. Analogous materials can be added to radiation cured epoxies, such as glycidyltrimethyl ammonium chloride and variants thereof, to provide a covalently bound antistatic coating with adequate water vapor barrier properties. Also suitable as antistatic agents are inherently conductive polymers, such as polypyrroles, polythiophenes, or the like.

Optionally, if desired, the back coating can also contain one or more fillers, including beads. Any desired filler can be employed. Examples of suitable fillers and beads include those listed hereinabove as being suitable for use in the image receiving coating, and in the amounts indicated as being suitable for the image receiving coating. Fillers and beads can affect the roughness of the back coating, and thereby provide control of the coefficient of friction. Fillers can also provide added opacity. Further, some fillers, such as clay and other plate-like particles that can orient in the plane of the coating surface, can augment water vapor transmission rates.

The back coating has a surface resistivity at 50 percent relative humidity and at about 23° C. typically of at least about $1\times10^{7}$ ohms per square, preferably at least about $1\times10^{8}$ ohms per square, and more preferably at least about $1\times10^{9}$ ohms per square, and typically of no more than about $1\times10^{16}$ ohms per square, preferably no more than about $1\times10^{14}$ ohms per square, and more preferably no more than about $10\times10^{11}$ ohms per square, although the surface resistivity of the image receiving coating can be outside of these ranges. The surface resistivity at 50 percent relative humidity and at about 23° C. of the back coating typically is within about 10 percent of the surface resistivity at 50 percent relative humidity and at about 23° C. of the base sheet when expressed on a logarithmic scale, i.e., if the surface resistivity of the base sheet is about $5\times10^{10}$ ohms per square, the surface resistivity of the back coating is from about $5\times10^{9}$ ohms per square to about $5\times10^{11}$ ohms per square. In a specific embodiment, the surface resistivity at 50 percent relative humidity and at about 23° C. of the back coating is higher than the surface resistivity at 50 percent relative humidity and at about 23° C. of the image receiving coating. It should be noted that the surface resistivity of the back coating is affected by the presence of intermediate coatings, pigment coatings placed on commercially obtained base sheets, or any other coating situated between the base sheet and the back coating. The values stated herein for the surface resistivity of the back coating refer to those values measured on the back coating after it has been coated onto any intermediate layers present on the base sheet.

The back coating can be selected so that this back coating does not adhere to the fusing apparatus of the selected printer during the printing process. Control of adhesion of the back coating to the fuser can be achieved by any desirable method, such as by selecting the coating material to have a molecular weight sufficiently high to prevent adhesion, selecting a crosslinked coating material to prevent adhesion, including a release agent, such as a wax or a silicone surfactant or the like, in the back coating composition to prevent adhesion, or the like.

The back coating is present on the second surface of the base sheet in any desired or effective thickness, typically at least about 0.5 micron, preferably at least about 1 micron, and more preferably at least about 2 microns, and typically no more than about 50 microns, preferably no more than about 25 microns, and more preferably no more than about 5 microns, although the thickness can be outside of these ranges.

In one specific embodiment, either the image receiving coating, or the back coating, or both the image receiving coating and the back coating, has/have low moisture permeability. More particularly, the water vapor transmission rate at 73° F. and 50 percent relative humidity of either the image receiving coating, or the back coating, or both the image receiving coating and the back coating, in one embodiment is at least about 0.1 grams per 100 square inches per day (g/100 $in^2$·day), and in one embodiment is no more than about 100 g/100 $in^2$·day, in another embodiment is no more than about 50 g/100 $in^2$·day, in yet another embodiment is no more than about 30 g/100 $in^2$·day, in still another embodiment is no more than about 25 g/100 $in^2$·day, and in yet still another embodiment is no more than about 10 g/100 $in^2$·day, although the water vapor transmission rate of either the image receiving coating, or the back coating, or both the image receiving coating and the back coating can be outside of these ranges.

The image receiving and back coatings can be applied to the cellulosic substrate by any suitable technique. For example, the layer coatings can be applied by techniques such as melt extrusion, reverse roll coating, solvent extrusion, and dip coating processes. In dip coating, a web of material to be coated is transported below the surface of the coating material (which generally is dissolved in a solvent) by a single roll in such a manner that the exposed site is saturated, followed by the removal of any excess coating by a blade, bar, or squeeze roll; the process is then repeated with the appropriate coating materials for application of the other layered coatings. With reverse roll coating, the premetered coating material (which generally is dissolved in a solvent) is transferred from a steel applicator roll onto the web material to be coated. The metering roll is stationary or is rotating slowly in the direction opposite to that of the applicator roll. In slot extrusion coating, a flat die is used to apply coating material (which generally is dissolved in a solvent) with the die lips in close proximity to the web of material to be coated. The die can have one or more slots if multilayers are to be applied simultaneously. In multilayer slot coating, the coating solutions form a liquid stack in the gap where the liquids come in the contact with the moving web to form a coating. The stability of the interface between the two layers depends on wet thickness, density, and viscosity ratios of both layers which need to be kept as close to one as possible. Once the desired amount of coating has been applied to the web, the coating is dried, typically at from about 25 to about 150° C. in an air dryer. Extrudable coatings can be prepared by melt-forming processes encompassing calendering and various methods of extrusion, such as blown bubble, slot-die casting, and coating on a substrate, as disclosed in the *Encyclopedia of Chemical Technology*, Vol. 10, p. 234–245, Wiley-Interscience (1978), the disclosure of which is totally incorporated herein by reference. In calendering, a continuous film is formed by squeezing a thermoplastic material between two or more horizontal metal rolls.

The present invention is also directed to a process for generating images which comprises (1) generating an electrostatic latent image on an imaging member in an imaging apparatus; (2) developing the latent image; and (3) transferring the developed image to a recording paper according to the present invention. Either dry particulate single-component and two-component (toner and carrier) developers or liquid developers (electrophoretic, polarizable, or the like) can be employed to develop the latent image. The developed image can be transferred to the recording paper by any suitable technique conventionally used in electrophotography, such as corona transfer, pressure transfer, adhesive transfer, bias roll transfer, and the like. Typical corona transfer entails contacting the deposited toner particles with a sheet of paper and applying an electrostatic charge on the side of the sheet opposite to the toner particles. A single wire corotron having applied thereto a potential of between about 5000 and about 8000 volts provides satisfactory electrostatic charge for transfer. Optionally, the transferred image can be permanently affixed to the recording sheet. The fixing step can be identical to that conventionally used in electrophotographic imaging. Typical, well known electrophotographic fusing techniques include heated roll fusing, flash fusing, oven fusing, laminating, adhesive spray fixing, and the like.

The recording sheets of the present invention can also be used in any other printing or imaging process, such as printing with pen plotters, handwriting with ink pens, offset printing processes, or the like, provided that the ink employed to form the image is compatible with the ink receiving layer of the recording paper.

Specific embodiments of the invention will now be described in detail. These examples are intended to be illustrative, and the invention is not limited to the materials, conditions, or process parameters set forth in these embodiments. All parts and percentages are by weight unless otherwise indicated.

EXAMPLE I

A recording paper is prepared as follows. The base sheet used is XEROX COLOR XPRESSIONS® 80 lb. Cover Gloss, having a dielectric constant of 4 under conditions of about 50 percent relative humidity and at about 23° C., a weight of 216 grams per square meter, a surface resistivity of $1\times10^{11}$ ohms per square as measured with a Charleswater meter, a thickness of 173 microns, and a stiffness in machine direction of 1,300 Gurley units. The CIE L*a*b color values of this paper are L*=96, a*=−0.3, b*=−0.3.

To the first surface of this base sheet is applied an image receiving coating comprising 93 percent by weight of a poly(4,4'dipropoxy-2,2'-diphenyl propane fumarate) binder (FineTone 382 ES-HMW, available from Reichhold), 0.5 percent by weight of a silica filler (Syloid 74, available from Grace Davison, 5 to 6 microns in diameter), 5 percent by weight of carnauba wax fuser releasing agent (Yellow Type 1, available from Relship Inc.), and 1.5 percent by weight of a quaternary amine antistatic agent (Cyastat LS, available from Cytec). The coating composition is dispersed in N-methyl pyrrolidinone and applied by a slot-die coating head to yield a coating weight of about 3.5 grams per square meter. It is believed that the coating thus applied will have a glass transition temperature ($T_g$) of about 58° C. It is believed that this image receiving coating will exhibit a water vapor transmission rate at 73° F. and 50 percent relative humidity of about 43 g/100 in$^2$·day for the coating itself for a combined WVTR on the pigment coating of the base sheet of less than 25 g/100 in$^2$·day. It is believed that this image receiving coating will exhibit a surface resistivity of from about $1\times10^{10}$ ohms per square to about $1\times10^{12}$ ohms per square. It is believed that this image receiving coating will exhibit a gloss value of from about 65 to about 85 GU prior to passing through the fuser of a printer and a gloss value of from about 75 to about 85 GU subsequent to passing through the fuser of a printer.

To the second surface of the base sheet is applied a base coating comprising 93.5 percent by weight VAPORCOAT 120 (aqueous emulsion available from Michelman, Inc.), 5 percent by weight MICHEM LUBE 156 (carnauba wax aqueous emulsion; available from Michelman, Inc.) and 1.5 percent by weight of a quaternary amine antistatic agent (Cyastat LS, available from Cytec) via a rod coater at a coating weight of about 15 grams per square meter. It is believed that this back coating will exhibit a water vapor transmission rate at 73° F. and 50 percent relative humidity of about 21 g/100 in$^2$·day. It is believed that this back coating will exhibit a resistivity of from $1\times10^{10}$ ohms per square to $1\times10^{12}$ ohms per square.

The paper thus prepared is incorporated into a XEROX® PHASER 7700 printer and images are generated thereon. It is believed that subsequent to transferring the developed image to the recording paper, the image receiving coating bearing the developed image will exhibit relatively uniform gloss with a variance of no more than about 25 GU. It is believed that similar results will be achieved with a XEROX® DocuColor 12 copier.

EXAMPLE II

A recording paper is prepared as follows. The base sheet used is XEROX COLOR XPRESSIONS® 80 lb. Cover Gloss. To the first surface of this base sheet is applied an image receiving coating comprising 93.5 percent by weight of a styrene-maleic anhydride copolymer binder (SMA2625, available from Atofina), 0.5 percent by weight of a silica filler (Syloid 74, available from Grace Davison, 5 to 6 microns in diameter), 5 percent by weight of behenic acid ester wax fuser releasing agent (Exceparl G-MB, available from Kao), and 1 percent by weight of a quaternary amine antistatic agent (Cyastat LS, available from Cytec). The coating composition is dispersed in a mixture of 50 percent by weight methyl ethyl ketone and 50 percent by weight ethyl acetate and applied by a gravure cylinder to yield a coating weight of about 2.5 grams per square meter. It is believed that the coating thus applied will have a glass transition temperature ($T_g$) of about 75° C. It is believed that this image receiving coating will exhibit a surface resistivity of from about $1\times10^{10}$ ohms per square to about $1\times10^{12}$ ohms per square. It is believed that this image receiving coating will exhibit a gloss value of from about 65 to about 85 GU. It is believed that this image receiving coating will exhibit a water vapor transmission rate of about 64 g/100 in$^2$·day, for a combined value with the pigment coating on the paper of about 28 g/100 in$^2$·day.

To the second surface of the base sheet is applied a base coating comprising 93.5 percent by weight VAPORCOAT 120 (aqueous emulsion available from Michelman, Inc.), 5 percent by weight MICHEM LUBE 156 (carnauba wax aqueous emulsion; available from Michelman, Inc.) and 1.5 percent by weight of a quaternary amine antistatic agent (Cyastat LS, available from Cytec) via a rod coater at a coating weight of about 15 grams per square meter. It is believed that this back coating will exhibit a water vapor transmission rate at 73° F. and 50 percent relative humidity of about 21 g/100 in$^2$·day. It is believed that this back coating will exhibit a resistivity of from $1\times10^{10}$ ohms per square to $1\times10^{12}$ ohms per square.

The paper thus prepared is incorporated into a XEROX® DocuColor 12 copier and images are generated thereon. It is believed that subsequent to transferring the developed image to the recording paper, the image receiving coating bearing the developed image will exhibit relatively uniform gloss with a variance of no more than about 25 GU. It is believed that similar results will be achieved with a KODAK® Color Edge copier.

EXAMPLE III

A recording paper is prepared as follows. The base sheet used is MEAD PRIMA GLOSS 100 lb. Book, having a dielectric constant of 5.4 under conditions of about 50 percent relative humidity and at about 23° C., a weight of 148 grams per square meter, a surface resistivity of $1\times10^{10.4}$ ohms per square as measured with a Charleswater meter, a thickness of 114 microns, and a stiffness in machine direction of 440 Gurley units. The CIE L*a*b color values of this paper are L*=96, a*=−1, b*=−3.2.

An intermediate coating is applied to the base sheet prior to application of the image receiving coating. The liquid emulsion comprising this intermediate coating comprises 20 percent by weight of a first acrylic copolymer emulsion binder (JONCRYL 660, available from SC Johnson Polymer), 20 percent by weight of a second acrylic copolymer emulsion binder (JONCRYL 2153, available from SC Johnson Polymer), 55 percent by weight of an antimony tin oxide antistatic agent (NanoTek 2400, available from Nanophase Technologies), and 5 percent by weight of an ammonium zirconium carbonate crosslinking agent (Azcote 5800M, available from EKA Chemicals) and is applied via a roll coater to yield a dry coating weight of about 1 gram per square meter.

To the intermediate coating on the base sheet is applied an image receiving coating comprising 94.1 percent by weight of a styrene-butyl acrylate copolymer binder Q(P-252, available from Sybron), 0.9 percent by weight of crosslinked polymethyl methacrylate filler beads (MR-10G, available from Soken Chemical & Eng. Co.), and 5 percent by weight of carnauba wax fuser releasing agent (Yellow Type 1, available from Relship Inc.). The coating composition is dispersed in a mixture of 50 percent by weight methyl ethyl ketone and 50 percent by weight ethyl acetate and applied by a slot-die coating head to yield a coating weight of about 3 grams per square meter. It is believed that the image receiving coating thus applied will have a glass transition temperature ($T_g$) of about 67° C. It is believed that this image receiving coating will exhibit a surface resistivity of from $1\times10^{9.4}$ ohms per square to $1\times10^{11.4}$ ohms per square. It is believed that this image receiving coating will exhibit a gloss value of from about 64 to about 86 GU. It is believed that the presence of this intermediate coating between the base sheet and the image receiving coating will reduce the water vapor transmission rate of the image receiving coating to about 115 g/100 in$^2$·day, for a combined value with the pigment coating on the paper of about 35 g/100 in$^2$·day.

To the second surface of the base sheet is applied a back coating comprising 45 percent by weight of urethane diacrylate (EBECRYL 244, available from UCB Chemicals), 9 percent by weight of trimethylolpropane ethoxytriacrylate (available from UCB Chemicals), 39 percent by weight of isobornylmethacrylate (available from UCB Chemicals), 3 percent by weight of a commercial solution containing 75 percent by weight 2-(methacryloyloxy)-ethyl)-trimethylammonium chloride and 25 percent by weight water (BM 606, available from Rohm America), 3 percent by weight of 1-benzoylcyclohexanol (IRGACURE 184, available from Ciba Specialty Chemicals), and 1 percent by weight of a silicone wetting agent (SILWET 7602, available from OSi Specialties by Crompton). The coating composition is applied with a roll coater to yield a coating weight of 5 grams per square meter. The image receiving coating is cured under medium pressure mercury lamps of about 200 to about 400 Watts per inch at about 100 to 1,000 feet per minute. It is believed that this back coating will exhibit a surface resistivity of from $1\times10^{9.4}$ ohms per square to $1\times10^{11.4}$ ohms per square. It is believed that this back coating will exhibit a water vapor transmission rate of about 60 g/100 in$^2$·day.

The paper thus prepared is incorporated into a XEROX® PHASER 750 printer and images are generated thereon. It is believed that subsequent to transferring the developed image to the recording paper, the image receiving coating bearing the developed image will exhibit relatively uniform gloss with a variance of no more than about 25 GU.

EXAMPLE IV

A recording paper is prepared as described in Example III except that in the image receiving coating the styrene-butyl acrylate copolymer binder RP-70, a high melt-viscosity, low melt index resin, available from Sybron, is substituted for XP-252, a low melt-viscosity, high melt index resin. It is believed that similar results will be obtained. In addition, it is believed that the image receiving coating of this example will be harder, more scratch resistant, and more resistant to sticking in the oil-less fuser system of a laser printer.

EXAMPLE V

A recording paper is prepared as follows. The base sheet used is XEROX COLOR XPRESSIONS® 80 lb. text gloss, having a dielectric constant of 4.3 under conditions of about 50 percent relative humidity and at about 23° C., a weight of 118 grams per square meter, a surface resistivity of $1\times10^{10.7}$ ohms per square as measured with a Charleswater meter, a thickness of 97 microns, and a stiffness in machine direction of 280 Gurley units. The CIE L*a*b color values of this paper are L*=96, a*=−1.7, b*=1.9.

An intermediate coating is applied to the base sheet prior to application of the image receiving coating. This intermediate coating comprises 100 percent by weight sodium polystyrene sulfonate (molecular weight about 200,000; VERSA TL, available from Alco, Inc.) applied with a gravure coater in a coating weight of 0.83 grams per square meter.

To the intermediate coating is applied an image receiving coating comprising 96.5 percent by weight poly(4,4'dipropoxy-2,2'diphenyl propane fumarate) binder (FineTone 382 ES-HMW, available from Reichhold), 0.5 percent by weight silica filler beads (Syloid 74, available from Grace Davison, 5 to 6 microns in diameter), and 3 percent by weight of carnauba wax fuser releasing agent (Yellow Type 1, available from Relship Inc.). The coating composition is dispersed in N-methyl pyrrolidinone and applied by a slot-die coating head to yield a coating weight of about 3.5 grams per square meter. It is believed that the coating thus applied will have a glass transition temperature ($T_g$) of about 58° C. It is believed that this image receiving coating will exhibit a water vapor transmission rate at 73° F. and 50 percent relative humidity of about 43 g/100 in$^2$·day for the coating itself, with a combined effect with the intermediate layer and with the existing pigment coating on the paper of about 22 g/100 in$^2$·day. It is believed that this image receiving coating will exhibit a gloss value of from about 65 to about 85 GU prior to passing through the fuser of a printer and a gloss value of from about 75 to about 85 GU subsequent to passing through the fuser of a printer. It is believed that this image receiving coating will exhibit a surface resistivity of from $1\times10^{9.7}$ ohms per square to $1\times10^{11.7}$ ohms per square.

To the second surface of the base sheet is applied a base coating comprising 88.5 percent by weight polyethylene terephthalate (available from DuPont), 10 percent by weight titanium dioxide filler (available from DuPont; density 4.2 grams per cubic centimeter) and 1.5 percent by weight of a quaternary amine antistatic agent (Cyastat LS, available from Cytec) by extrusion coating to provide a coating thickness of about 16.5 microns thick. It is believed that this back coating will exhibit a water vapor transmission rate at 73° F. and 50 percent relative humidity of about 2.8 g/100 in$^2$·day. It is believed that this back coating will exhibit a surface resistivity of from $1\times10^{9.7}$ ohms per square to $1\times10^{11.7}$ ohms per square.

The paper thus prepared is incorporated into a XEROX® PHASER 2135 printer and images are generated thereon. It is believed that subsequent to transferring the developed image to the recording paper, the image receiving coating bearing the developed image will exhibit relatively uniform gloss with a variance of no more than about 25 GU.

EXAMPLE VI

A recording paper is prepared as described in Example V except that the back coating comprises comprising 45 percent by weight of urethane diacrylate (EBECRYL 244, available from UCB Chemicals), 9 percent by weight of trimethylolpropane ethoxytriacrylate (available from UCB Chemicals), 39 percent by weight of isobornylmethacrylate (available from UCB Chemicals), 3 percent by weight of a commercial solution containing 75 percent by weight 2-(methacryloyloxy)-ethyl)-trimethylammonium chloride and 25 percent by weight water (BM 606, available from Rohm America), 3 percent by weight of 1-benzoylcyclohexanol (IRGACURE 184, available from Ciba Specialty Chemicals), and 1 percent by weight of a silicone wetting agent (SILWET 7602, available from OSi Specialties by Crompton). The coating composition is applied with a roll coater to yield a coating weight of 5 grams per square meter. The back coating is cured under medium pressure mercury lamps of about 200 to about 400 Watts per inch at about 100 to 1,000 feet per minute. It is believed that this back coating will exhibit a surface resistivity of from $1\times10^{9.7}$ ohms per square to $1\times10^{11.7}$ ohms per square.

The paper thus prepared is incorporated into a XEROX® PHASER 750 printer and images are generated thereon. It is believed that subsequent to transferring the developed image to the recording paper, the image receiving coating bearing the developed image will exhibit relatively uniform gloss with a variance of no more than about 25 GU.

EXAMPLE VII

A recording paper is prepared as described in Example VI except that a different intermediate coating is applied to both surfaces of the base sheet prior to application of the image receiving coating and back coating. The liquid emulsion comprising this intermediate coating comprises 20 percent by weight of a first acrylic copolymer emulsion binder (JONCRYL 660, available from SC Johnson Polymer), 20 percent by weight of a second acrylic copolymer emulsion binder (JONCRYL 2153, available from SC Johnson Polymer), 55 percent by weight of an antimony tin oxide antistatic agent (NanoTek 2400, available from Nanophase Technologies), and 5 percent by weight of an ammonium zirconium carbonate crosslinking agent (Azcote 5800M, available from EKA Chemicals) applied with a roll coater to yield a dry coating weight of about 1 gram per square meter. It is believed that the presence of this intermediate coating between the base sheet and the image receiving coating will further reduce the water vapor transmission rate of the image receiving coating and that the presence of this intermediate coating between the base sheet and the back coating will further reduce the water vapor transmission rate of the back coating.

The paper thus prepared is incorporated into a XEROX® PHASER 2135 printer and images are generated thereon. It is believed that subsequent to transferring the developed image to the recording paper, the image receiving coating bearing the developed image will exhibit relatively uniform gloss with a variance of no more than about 25 GU.

EXAMPLE VIII

A recording paper is prepared as follows. The base sheet used is WEYERHAEUSER FIRST CHOICE 32 lb. White, having a dielectric constant of 5 under conditions of about 50 percent relative humidity and at about 23° C., a weight of 120 grams per square meter, a surface resistivity of $1\times10^{9.7}$ ohms per square as measured with a Charleswater meter, a thickness of 152 microns, and a stiffness in machine direction of 540 Gurley units. The CIE L*a*b color values of this paper are L*=97, a*=−0.4, b*=−6.6.

An intermediate coating is applied to the base sheet prior to application of the image receiving coating. This intermediate coating comprises 100 percent by weight sodium polystyrene sulfonate (molecular weight about 200,000; VERSA TL, available from Alco, Inc.) applied with a gravure coater head in a coating weight of 0.83 grams per square meter.

To the intermediate coating on the base sheet is applied an image receiving coating comprising 99.5 percent by weight poly(4,4'dipropoxy-2,2'-diphenyl propane fumarate) binder (FineTone 382 ES-HMW, available from Reichhold) and 0.5 percent by weight silica filler beads (Syloid 74, available from Grace Davison, 5 to 6 microns in diameter). The coating composition is dispersed in N-methyl pyrrolidinone and applied by a slot-die coating head to yield a coating weight of about 5 grams per square meter. It is believed that the coating thus applied will have a glass transition temperature ($T_g$) of about 58° C. It is believed that this image receiving coating will exhibit a water vapor transmission rate at 73° F. and 50 percent relative humidity of about 29 g/100 in$^2$·day. It is believed that this image receiving coating will exhibit a gloss value of from about 65 to about 85 GU. It is believed that this image receiving coating will exhibit a surface resistivity of from $1\times10^{8.7}$ ohms per square to $1\times10^{10.7}$ ohms per square.

To the second surface of the base sheet is applied a base coating comprising 88 percent by weight polyethylene terephthalate (available from DuPont), 10 percent by weight titanium dioxide filler (available from DuPont, density 4.2 grams per cubic centimeter), and 2 percent by weight of a sodium alkyl sulfonate antistatic agent (ARMOSTAT 3002, available from Akzo Nobel) by extrusion coating to provide a coating weight of about 24.4 grams per square meter. It is believed that this back coating will exhibit a water vapor transmission rate at 73° F. and 50 percent relative humidity of about 2.8 g/100 in$^2$·day. It is believed that this back coating will exhibit a surface resistivity of from $1\times10^{10}$ ohms per square to $1\times10^{11}$ ohms per square.

The paper thus prepared is incorporated into a XEROX® PHASER 750 printer and images are generated thereon. It is believed that subsequent to transferring the developed image to the recording paper, the image receiving coating bearing the developed image will exhibit relatively uniform gloss with a variance of no more than about 25 GU.

EXAMPLE IX

A recording paper is prepared as follows. The base sheet used is WEYERHAEUSER FIRST CHOICE 32 lb. White, having a dielectric constant of 5 under conditions of about 50 percent relative humidity and at about 23° C., a weight of 120 grams per square meter, a surface resistivity of $1\times10^{9.7}$ ohms per square as measured with a Charleswater meter, a thickness of 152 microns, and a stiffness in machine direction of 540 Gurley units. The CIE L*a*b color values of this paper are L*=97, a*=−0.4, b*=−6.6.

A first intermediate coating is applied to the base sheet prior to application of the image receiving coating. This first intermediate coating comprises 88 percent by weight polyethylene terephthalate (available from DuPont), 10 percent by weight titanium dioxide filler (available from DuPont; density 4.2 grams per cubic centimeter), and 2 percent by weight of a sodium alkyl sulfonate antistatic agent (ARMOSTAT 3002, available from Akzo Nobel) by extrusion coating to provide a coating weight of about 24.4 grams per square meter. It is believed that this first intermediate coating will exhibit a water vapor transmission rate at 73° F. and 50 percent relative humidity of about 2.8 g/100 in$^2$·day.

A second intermediate coating is applied to the first intermediate coating prior to application of the image receiving coating. This second intermediate coating comprises 100 percent by weight sodium polystyrene sulfonate (molecular weight about 200,000; VERSA TL, available from Alco, Inc.) applied with a gravure coater head in a coating weight of 0.83 grams per square meter.

To the second intermediate coating on the base sheet is applied an image receiving coating comprising 99.5 percent by weight poly(4,4'dipropoxy-2,2'-diphenyl propane fumarate) binder (FineTone 382 ES-HMW, available from Reichhold) and 0.5 percent by weight silica filler beads (Syloid 74, available from Grace Davison, 5 to 6 microns in diameter). The coating composition is dispersed in N-methyl pyrrolidinone and applied by a slot-die coating head to yield a coating weight of about 5 grams per square meter. It is believed that the coating thus applied will have a glass transition temperature ($T_g$) of about 58° C. It is believed that this image receiving coating will exhibit a water vapor transmission rate at 73° F. and 50 percent relative humidity of about 30 g/100 $in^2$·day for the coating itself, with a combined effect with the intermediate layers and with the existing pigment coating on the paper of about 2.6 g/100 $in^2$·day. It is believed that this image receiving coating will exhibit a gloss value of from about 65 to about 85 GU. It is believed that this image receiving coating will exhibit a surface resistivity of from $1\times10^{8.7}$ ohms per square to $1\times10^{10.7}$ ohms per square.

To the second surface of the base sheet is applied a back coating comprising 88 percent by weight polyethylene terephthalate (available from DuPont), 10 percent by weight titanium dioxide filler (available from DuPont; density 4.2 grams per cubic centimeter), and 2 percent by weight of a sodium alkyl sulfonate antistatic agent (ARMOSTAT 3002, available from Akzo Nobel) by extrusion coating to provide a coating weight of about 24.4 grams per square meter. It is believed that this back coating will exhibit a water vapor transmission rate at 73° F. and 50 percent relative humidity of about 2.8 g/100 $in^2$·day. It is believed that this back coating will exhibit a surface resistivity of from $1\times10^{10}$ ohms per square to $1\times10^{11}$ ohms per square.

The paper thus prepared is incorporated into a XEROX® PHASER 780 Printer and images are generated thereon. It is believed that subsequent to transferring the developed image to the recording paper, the image receiving coating bearing the developed image will exhibit relatively uniform gloss with a variance of no more than about 25 GU. It is believed that similar results will be achieved with a CANON® CLC copier.

Other embodiments and modifications of the present invention may occur to those of ordinary skill in the art subsequent to a review of the information presented herein; these embodiments and modifications, as well as equivalents thereof, are also included within the scope of this invention.

The recited order of processing elements or sequences, or the use of numbers, letters, or other designations therefor, is not intended to limit a claimed process to any order except as specified in the claim itself.

What is claimed is:

1. A recording paper which comprises (a) a cellulosic base sheet having a first surface and a second surface opposite the first surface, said base sheet having a dielectric constant of at least about 1.5, said base sheet having a dielectric constant of no more than about 10, said base sheet having, under conditions of about 50 percent relative humidity and at about 23° C., a surface resistivity of at least about $1\times10^7$ ohms per square, said base sheet having, under conditions of about 50 percent relative humidity and at about 23° C., a surface resistivity of no more than about $1\times10^{13}$ ohms per square; (b) on the first surface of the base sheet an image receiving coating comprising a monomeric or polymeric material, said image receiving coating having a glass transition temperature of at least about 55° C., said image receiving coating having a surface resistivity that is within about 10 percent of the surface resistivity of the base sheet, said image receiving coating having a gloss value of at least about 50 GU; and (c) on the second surface of the base sheet a back coating comprising a monomeric or polymeric material, said back coating having a surface resistivity that is within about 10 percent of the surface resistivity of the base sheet.

2. A recording paper according to claim 1 wherein the base sheet has, under conditions of about 50 percent relative humidity and at about 23° C., a bulk resistivity of at least about $1\times10^7$ ohm-cm, and wherein the base sheet has, under conditions of about 50 percent relative humidity and at about 23° C., a bulk resistivity of no more than about $1\times10^{13}$ ohm-cm.

3. A recording paper according to claim 1 wherein the base sheet has a stiffness in machine direction of at least about 300 Gurley units, and wherein the base sheet has a stiffness in machine direction of no more than about 2,500 Gurley units.

4. A recording paper according to claim 1 wherein the base sheet has a weight of at least about 50 grams per square meter, and wherein the base sheet has a weight of no more than about 300 grams per square meter.

5. A recording paper according to claim 1 wherein the image receiving coating comprises a material selected from the group consisting of polyesters, polyvinyl acetals, polyvinyl acetates, vinyl alcohol-vinyl acetal copolymers, polycarbonates, copolymers of styrene and at least one other monomer, copolymers containing acrylic monomers and at least one other monomer, and mixtures thereof.

6. A recording paper according to claim 1 wherein the image receiving coating comprises a material selected from the group consisting of polyester latexes, poly(4,4-dipropoxy-2,2'-diphenyl propane fumarate), poly(ethylene terephthalate), poly(ethylene succinate), poly(1,4-cyclohexane dimethylene succinate), styrene-butadiene copolymers, styrene-ethylene-butylene copolymers, styrene-isoprene copolymers, styrene-alkyl acrylate copolymers, styrene-aryl acrylate copolymers, styrene-alkyl methacrylate copolymers, styrene-aryl methacrylate copolymers, styrene-butylmethacrylate copolymers, styrene-allyl alcohol copolymers, styrene-maleic anhydride copolymers, and mixtures thereof.

7. A recording paper according to claim 1 wherein the image receiving coating comprises a polymer with a weight average molecular weight of at least about 40,000, and wherein the image receiving coating comprises a polymer with a weight average molecular weight of no more than about 80,000.

8. A recording paper according to claim 1 wherein the image receiving coating contains a fuser releasing agent.

9. A recording paper according to claim 8 wherein the fuser releasing agent is selected from the group consisting of carnauba wax, polyproprene, polyethylene, ester waxes, and mixtures thereof.

10. A recording paper according to claim 8 wherein the fuser releasing agent has a melting point of at least about 60° C., and wherein the fuser releasing agent has a melting point of no more than about 110° C.

11. A recording paper according to claim 8 wherein the fuser releasing agent is present in the image receiving coating in an amount of at least about 1 percent by weight of the coating, and wherein the fuser releasing agent is present in the image receiving coating in an amount of no more than about 12 percent by weight of the coating.

12. A recording paper according to claim 1 wherein the image receiving coating contains an antistatic agent.

13. A recording paper according to claim 12 wherein the antistatic agent is selected from the group consisting of tin oxide, indium tin oxide, silicon dioxide-tin oxide, antimony tin oxide, titanium tin oxide, monoester sulfosuccinates, diester sulfosuccinates, sulfosuccinamates, diamino alkanes, polystyrene sulfonates, phosphonium sulfonates, sodium polyvinyl sulfuric acid, quaternary amines, and mixtures thereof.

14. A recording paper which comprises (a) a cellulosic base sheet having a first surface and a second surface opposite the first surface, said base sheet having a dielectric constant of at least about 1.5, said base sheet having a dielectric constant of no more than about 10, said base sheet having, under conditions of about 50 percent relative humidity and at about 23° C., a surface resistivity of at least about $1\times10^{7}$ ohms per square, said base sheet having, under conditions of about 50 percent relative humidity and at about 23° C., a surface resistivity of no more than about $1\times10^{13}$ ohms per square, (b) on the first surface of the base sheet an image receiving coating comprising a monomeric or polymeric material, said image receiving coating having a glass transition temperature of at least about 55° C., said image receiving coating having a surface resistivity that is within about 10 percent of the surface resistivity of the base sheet, said image receiving coating having a gloss value of at least about 50 GU; and (c) on the second surface of the base sheet a back coating comprising a monomeric or polymeric material, said back coating having a surface resistivity that is within about 10 percent of the surface resistivity of the base sheet, wherein the antistatic agent is a metal oxide.

15. A recording paper according to claim 14 wherein the antistatic agent is antimony tin oxide.

16. A recording paper according to claim 12 wherein the antistatic agent is present in the image receiving coating in an amount of at least about 0.1 percent by weight of the coating, and wherein the antistatic agent is present in the image receiving coating in an amount of no more than about 10 percent by weight of the coating.

17. A recording paper according to claim 1 wherein the image receiving coating has a surface roughness value of no more than about 1.4 microns, and wherein the image receiving coating has a surface roughness value of at least about 0.3 microns.

18. A recording paper according to claim 1 wherein the image receiving coating is present on the first surface of the base sheet in a thickness of at least about 0.5 micron, and wherein the image receiving coating is present on the first surface of the base sheet in a thickness of no more than about 6 microns.

19. A recording paper according to claim 1 wherein the back coating comprises a material selected from the group consisting of polyesters, polyethylene, polypropylene, nylon 6, nylon 6,6, acrylic polymers, styrene-acrylic copolymers, urethane diacrylate, trimethylolpropane ethoxytriacrylate, isobornylmethacrylate, and mixtures thereof.

20. A recording paper according to claim 1 wherein the back coating contains an antistatic agent.

21. A recording paper according to claim 20 wherein the antistatic agent is selected from the group consisting of tin oxide, indium tin oxide, silicon dioxide-tin oxide, antimony tin oxide, titanium tin oxide, monoester sulfosuccinates, diester sulfosuccinates, sulfosuccinamates, diamino alkanes, polystyrene sulfonates, phosphonium sulfonates, sodium polyvinyl sulfuric acid, quaternary amines, polypyrroles, polythiophenes, and mixtures thereof.

22. A recording paper according to claim 20 wherein the antistatic agent is present in the back coating in an amount of at least about 0.1 percent by weight of the coating, and wherein the antistatic agent is present in the back coating in an amount of no more than about 10 percent by weight of the coating.

23. A recording paper according to claim 1 wherein the surface resistivity at 50 percent relative humidity and at about 23° C. of the back coating is higher than the surface resistivity at 50 percent relative humidity and at about 23° C. of the image receiving coating.

24. A recording paper according to claim 1 wherein the back coating is present on the second surface of the base sheet in a thickness of at least about 0.5 micron, and wherein the back coating is present on the second surface of the base sheet in a thickness of no more than about 50 microns.

25. A recording paper according to claim 1 wherein the water vapor transmission rate at 73° F. and 50 percent relative humidity of the image receiving coating is no more than about 100 g/100 $in^2$·day.

26. A recording paper according to claim 1 wherein the water vapor transmission rate at 73° F. and 50 percent relative humidity of the back coating is no more than about 100 g/100 $in^2$·day.

27. A recording paper according to claim 1 wherein the water vapor transmission rate at 73° F. and 50 percent relative humidity of the image receiving coating is no more than about 100 g/100 $in^2$·day and wherein the water vapor transmission rate at 73° F. and 50 percent relative humidity of the back coating is no more than about 100 g/100 $in^2$·day.

28. A recording paper which comprises (a) a cellulosic base sheet having a first surface and a second surface opposite the first surface, said base sheet having a dielectric constant of at least about 2 under conditions of about 50 percent relative humidity and at about 23° C., said base sheet having a dielectric constant of no more than about 9 under conditions of about 50 percent relative humidity and at about 23° C., said base sheet having, under conditions of about 50 percent relative humidity and at about 23° C., a surface resistivity of at least about $1\times10^{8}$ ohms per square, said base sheet having, under conditions of about 50 percent relative humidity and at about 23° C., a surface resistivity of no more than about $1\times10^{12}$ ohms per square, said base sheet having a stiffness in machine direction of at least about 300 Gurley units; (b) on the first surface of the base sheet an image receiving coating comprising a monomeric or polymeric material, said image receiving coating having a glass transition temperature of at least about 55° C., said image receiving coating having a surface resistivity that is within about 10 percent of the surface resistivity of the base sheet, said image receiving coating having a gloss value of at least about 70 GU; and (c) on the second surface of the base sheet a back coating comprising a monomeric or polymeric material, said back coating having a surface resistivity that is within about 10 percent of the surface resistivity of the base sheet, wherein at least one of the image receiving coating and the back coating has a water vapor transmission rate at 73° F. and 50 percent relative humidity of no more than about 100 g/100 $in^2$·day.

29. A process for generating images which comprises (1) generating an electrostatic latent image on an imaging member in an imaging apparatus; (2) developing the latent image; and (3) transferring the developed image to a recording paper which comprises (a) a cellulosic base sheet having a first surface and a second surface opposite the first surface, said base sheet having a dielectric constant of at least about 1.5 under conditions of about 50 percent relative humidity and at about 23° C., said base sheet having a dielectric constant of no more than about 10 under conditions of about 50 percent relative humidity and at about 23° C., said base sheet having, under conditions of about 50 percent relative humidity and at about 23° C., a surface resistivity of at least about $1\times10^{7}$ ohms per square, said base sheet having, under conditions of about 50 percent relative humidity and at about 23° C., a surface resistivity of no more than about $1\times10^{13}$ ohms per square; (b) on the first surface of the base sheet an image receiving coating comprising a monomeric or polymeric material, said image receiving coating having a glass transition temperature of at least about 55° C., said image receiving coating having a surface resistivity that is within about 10 percent of the surface resistivity of the base sheet, said image receiving coating having a gloss value of at least about 50 GU; and (c) on the second surface of the base sheet a back coating comprising a monomeric or polymeric material, said back coating having a surface resistivity that is within about 10 percent of the surface resistivity of the base sheet.

30. A process according to claim 29 wherein, subsequent to transferring the developed image to the recording paper, the image receiving coating bearing the developed image exhibits relatively uniform gloss with a variance of no more than about 25 GU.

31. A process according to claim 29 wherein, subsequent to transferring the developed image to the recording paper, the image receiving coating bearing the developed image exhibits relatively uniform gloss with a variance of no more than about 15 GU.

32. A process according to claim 29 wherein, subsequent to transferring the developed image to the recording paper, the image receiving coating bearing the developed image exhibits relatively uniform gloss with a variance of no more than about 6 GU.

* * * * *